US006945502B2

(12) United States Patent
Restifo

(10) Patent No.: US 6,945,502 B2
(45) Date of Patent: Sep. 20, 2005

(54) PORTABLE TABLE

(75) Inventor: Nicholas A. Restifo, 1217 Sandstone Ct. East, Tarentum, PA (US) 15084

(73) Assignee: Nicholas A. Restifo, Tarentum, PA (US)

( * ) Notice: Subject to any disclaimer, the term of this patent is extended or adjusted under 35 U.S.C. 154(b) by 0 days.

(21) Appl. No.: 10/621,804

(22) Filed: Jul. 17, 2003

(65) Prior Publication Data

US 2004/0011931 A1 Jan. 22, 2004

Related U.S. Application Data

(60) Provisional application No. 60/396,419, filed on Jul. 17, 2002.

(51) Int. Cl.[7] ..... A47G 23/02

(52) U.S. Cl. ..... 248/146; 248/146

(58) Field of Search ..... 248/146, 530, 248/156, 176.1, 131, 311.2; D6/416, 417

(56) References Cited

U.S. PATENT DOCUMENTS 2,076,010 A * 4/1937 String ..... 473/591
D163,617 S * 6/1951 Lilja ..... D6/417
2,877,828 A * 3/1959 Barnette, Jr. ..... 248/533
2,924,338 A * 2/1960 Sharp ..... 211/85
3,119,619 A * 1/1964 Dean ..... 273/336
3,141,644 A * 7/1964 Baird ..... 248/146
4,176,819 A * 12/1979 Lowe ..... 248/513
D264,483 S * 5/1982 Raymond ..... D21/304
4,407,475 A * 10/1983 Gossage ..... 248/156
4,497,077 A * 2/1985 Provost ..... 4/628
4,702,445 A * 10/1987 Ivory ..... 248/100
4,854,468 A * 8/1989 Dahlquist et al. ..... 220/737
4,966,373 A * 10/1990 Houle et al. ..... 273/339
5,046,699 A * 9/1991 Perreault et al. ..... 248/533
5,330,145 A * 7/1994 Evans et al. ..... 248/311.2
5,342,007 A * 8/1994 LaPlante ..... 248/131
D353,742 S * 12/1994 Lewis et al. ..... D7/558
D366,372 S * 1/1996 Skarda, Jr. ..... D6/417
5,647,075 A * 7/1997 Perkins ..... 5/127
5,713,546 A * 2/1998 Auspos ..... 248/156
5,915,561 A * 6/1999 Lorenzana et al. ..... 206/562
5,924,659 A * 7/1999 Babcock ..... 248/146
D464,499 S * 10/2002 Gharst ..... D6/416
6,575,417 B1 * 6/2003 Krommenakker ..... 248/311.2
6,675,819 B2 * 1/2004 Arrowood et al. ..... 135/16
6,705,240 B2 * 3/2004 Block et al. ..... 108/150
6,732,985 B1 * 5/2004 Cantrell ..... 248/125.1

* cited by examiner

*Primary Examiner*—Anita M. King
(74) *Attorney, Agent, or Firm*—The Webb Law Firm

(57) ABSTRACT

A portable containment unit stand is disclosed and includes a cross member and one or more support members attached to and extending away from the cross member. The support members support the cross member in a position above a ground surface, such as grass, dirt or the like. The portable containment unit also includes one, and typically multiple, receptacles positioned on the cross member for receiving one or multiple objects therein. The cross member may include one, and typically multiple, recessed portions for supporting parts or portions of objects, such as sports-related equipment.

17 Claims, 3 Drawing Sheets

PORTABLE TABLE

CROSS REFERENCE TO RELATED APPLICATION

This application claims the benefit of U.S. Provisional Patent Application Ser. No. 60/396,419, filed Jul. 17, 2002, the disclosure of which is fully incorporated herein.

FIELD OF THE INVENTION

The present invention relates generally to food and beverage containment units and stands and, in particular, to a portable and easily dismantled containment unit or stand.

BACKGROUND OF THE INVENTION

During the warmer seasons, many people are involved in various outside activities, such as sports activities and attendance of sporting events, concerts and the like. As most of the activities are engaged in outside and, further, most of these "entertainment" activities involve foods and beverages, people typically place their food and beverage containers on the ground, whether in the grass, dirt, cement, etc. While many people have outside furniture available for use in connection with home-based activities, such furniture may not be available in connection with other venues, such as sporting events or outside concerts. Therefore, there is a need for a portable containment unit that can be easily disassembled, moved and reassembled at various outside locations.

Many sports and leisure activities are able to be participated in, while the participant simultaneously is able to eat or drink, such as horseshoes, bocci, and other similar activities. Therefore, there is a need for a portable containment unit that is particularly adapted for use in connection with such activities.

SUMMARY OF THE INVENTION

Accordingly, it is an object of the present invention to provide a portable containment unit that overcomes the deficiencies of the prior art. It is another object of the present invention to provide a portable containment unit that is easily disassembled, moved and reassembled in various locations. It is yet another object of the present invention to provide a portable containment unit that is highly adaptable to many and varying ground surfaces. It is still another object of the present invention to provide a portable containment unit that is easy in its use and inexpensive in its manufacture.

The present invention is directed to a portable containment unit, which includes a cross member and one or more support members attached to and extending away from the cross member. The support members support the cross member in a position above a ground surface, such as grass, dirt or the like. The portable containment unit also includes one, and typically multiple, receptacles positioned on the cross member for receiving one or multiple objects therein. In a preferred embodiment, the cross member includes one, and typically multiple, recessed portions for supporting parts or portions of objects, such as sports-related equipment.

The present invention, both as to its construction and its method of operation, together with the additional objects and advantages thereof, will best be understood from the following description of exemplary embodiments when read in connection with the accompanying drawings.

DESCRIPTION OF THE PREFERRED EMBODIMENTS

Figure 1:
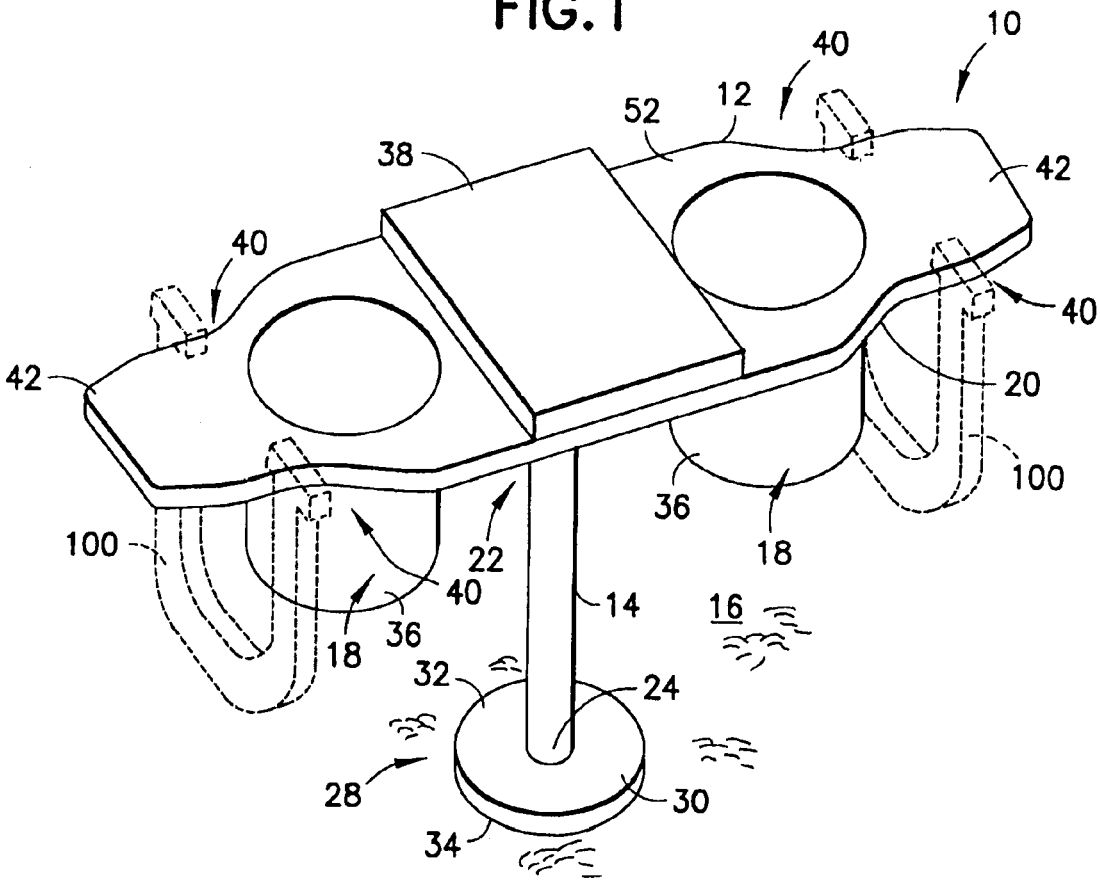
FIG. 1 is a perspective view of a first embodiment of a portable containment unit or stand according to the present invention.
Figure 2:
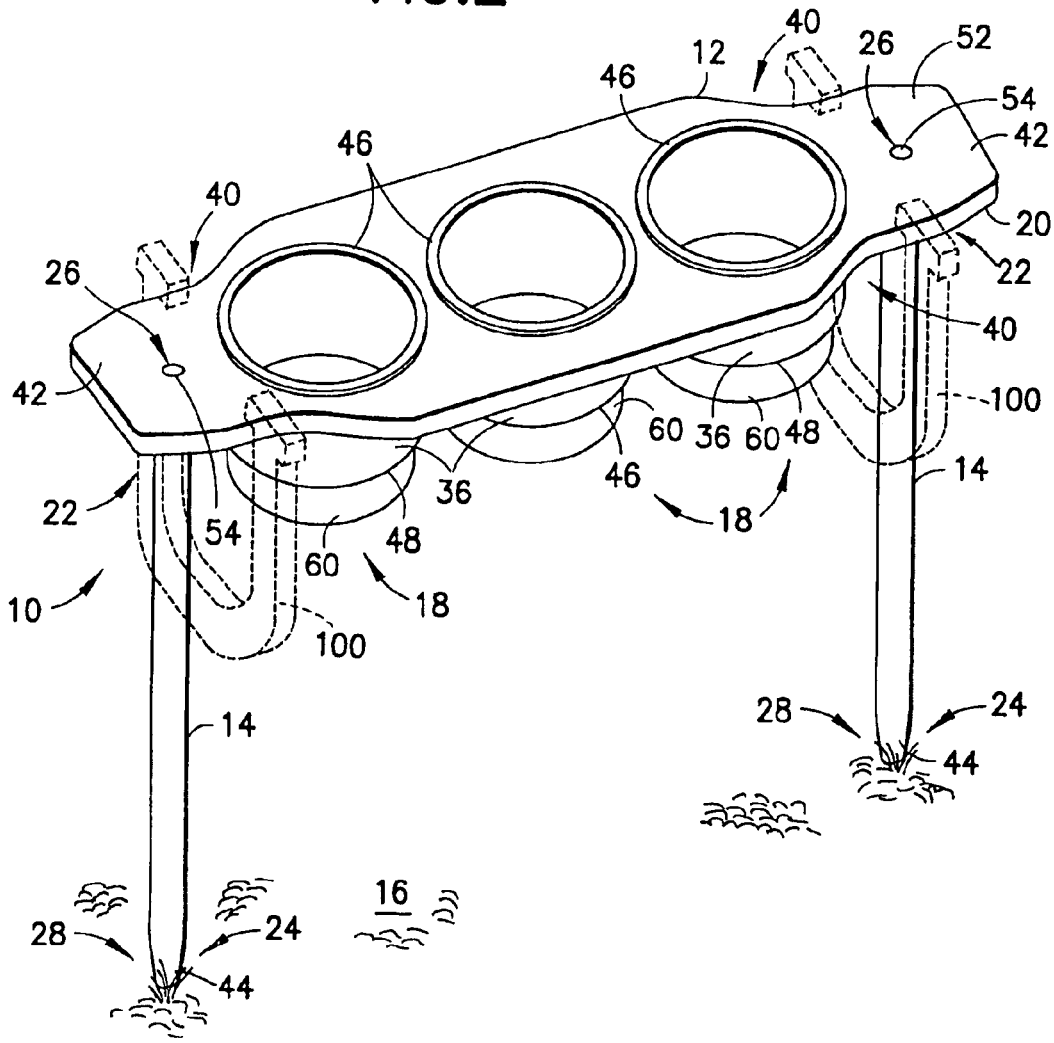
FIG. 2 is a perspective view of a second embodiment of a portable containment unit or stand according to the present invention.
Figure 3:
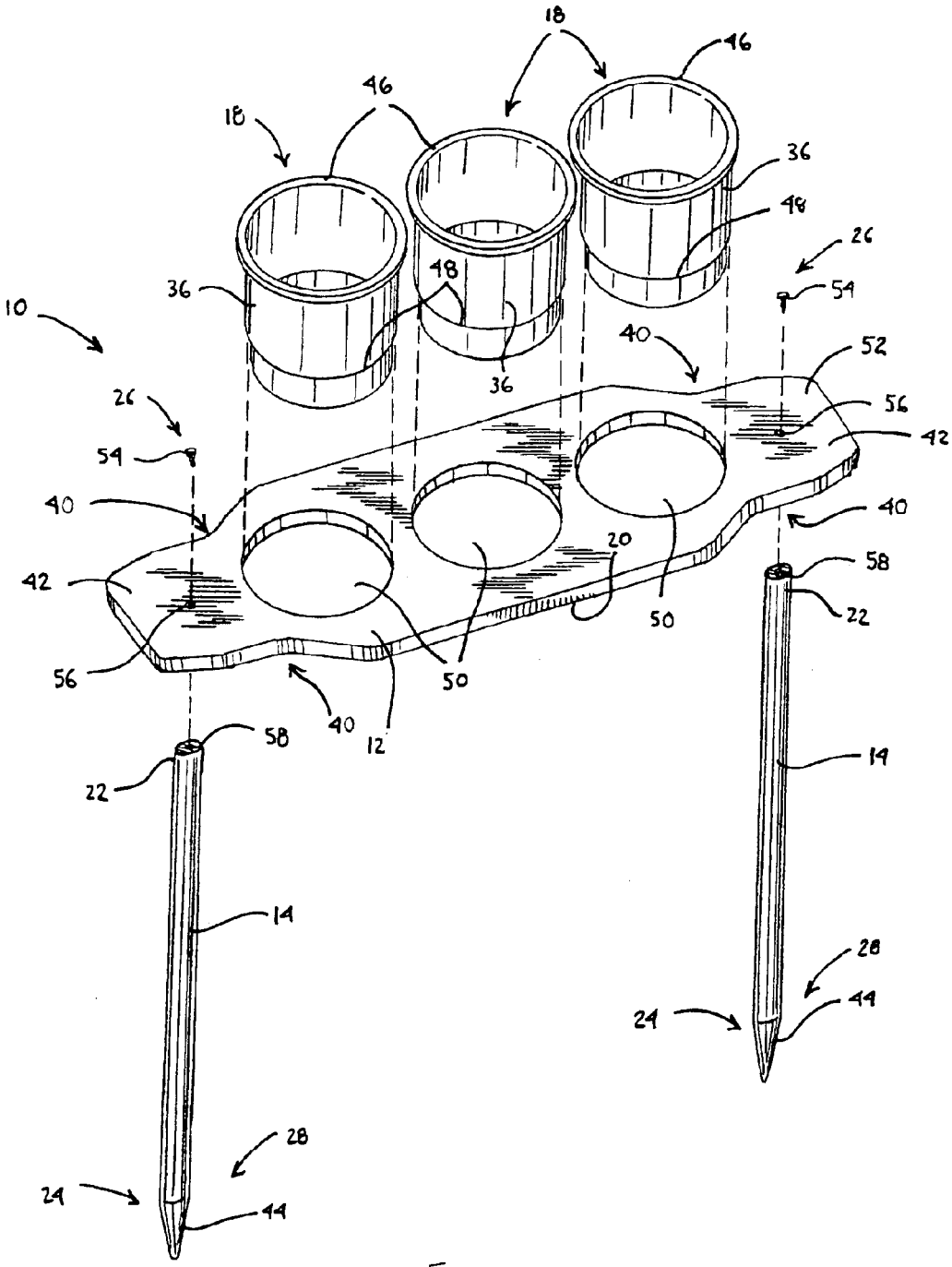
FIG. 3 is an exploded view of the portable containment unit of FIG. 2.

As illustrated in FIGS. 1–3, the present invention is a portable containment unit or stand 10 and includes a cross member 12. One or multiple support members 14 are attached to and extend away from the cross member 12. This support member 14 or support members 14 are used to support or position the cross member 12 at a distance above a ground surface 16. Further, the cross member 12 includes one or more receptacles 18 positioned and interrelated with the cross member 12. These receptacles 18 are able to receive one or multiple objects within them.

A first embodiment of the portable containment unit 10 is illustrated in FIG. 1. As seen in FIG. 1, in this embodiment, the portable containment unit 10 includes a single support member 14 attached to and extending away from a bottom surface 20 of the cross member 12. Specifically, the support member 14 is attached to and extends away from a substantially central area of the cross member bottom surface 20.

The support member 14 includes a support member first end 22 and a support member second end 24. The support member first end 22 is attached to the cross member bottom surface 20 via an attachment mechanism 26. It is envisioned that this attachment mechanism 26 can be a screw, a nail, adhesive or other means for securely attaching the support member first end 22 to the cross member bottom surface 20.

A positioning element 28 is located at or adjacent the support member second end 24. In this embodiment, the positioning element is a plate member 30. Further, in a preferred form, the plate member 30 is circular and has a plate member top surface 32 and a plate member bottom surface 34. The support member second end 24 is attached to the plate member top surface 32, and the plate member bottom surface 34 is adapted to rest upon or engage the ground surface 16. The plate member bottom surface 34 may be substantially flat, with the plate member bottom surface 34 resting directly upon the ground surface 16 or, alternatively, the plate member bottom surface 34 may have some other engagement mechanism (not shown) for removably attaching the plate member 30 to the ground surface 16. For example, spikes, pointed tips, or other piercing elements could be used. This would ensure that the portable containment unit 10 is not easily displaced or "knocked over."

In this embodiment, the cross member 12 has two receptacles 18 associated with it. These receptacles 18 are containers, which are able to contain or hold various objects, such as food or beverage objects. In a preferred embodiment, each receptacle 18 is a cup holder 36, which is capable of holding a glass, a cup or other beverage container. Alternatively, the receptacle 18 is sized and shaped so that it may also accept food products, such as chips, pretzels, candy and the like. The receptacles 18 may be made of any suitable material such as plastic, metal, or wood.

Positioned between the two receptacles 18 is a tray element 38. In a preferred embodiment, the tray element is a substantially flat surface, on which a user would rest a container, such as a bowl, cup or other food or beverage container. It is envisioned that this tray element 38 may also have a lip (not shown) located on the outer periphery of the tray element 38 for preventing objects or bowls from sliding off of the tray element 38 if the portable containment unit 10 is jarred or tipped.

The portable containment unit 10 includes recessed portions 40 within or on which portions of objects may be rested. Specifically, the recessed portions 40 may be capable of allowing a user to rest sports equipment on or against them, such as a baseball bat or other object. In a preferred embodiment, the recessed portions 40 are positioned on opposite sides of the cross member 12, thereby forming a tapered cross member end 42. This tapered cross member end 42 would be particularly adapted to receiving or allowing a user to hang a one or more horseshoes 100 on or over it. For example, the user may simply hook the horseshoe (100) over the tapered cross member end 42 or, alternatively, as typical horseshoes 100 include end lips or ridges, these lips could be partially slid over and hung from the tapered cross member end 42. It is envisioned that, when using the portable containment unit 10 in connection with weighty objects, such as sports-related equipment and horseshoes 100, the plate member 30 must be sufficiently sized so that the portable containment unit 10 does not easily topple.

The portable containment unit 10 may be manufactured from a variety of materials, such as wood, plastic, metal, composite, etc. Typically, in the interest of aesthetics and portability, the portable containment unit 10 would be manufactured from wood or plastic.

A second embodiment of the portable containment unit 10 is illustrated in FIGS. 2 and 3. In this embodiment, the portable containment unit 10 includes two support members 14 attached to and extending away from opposite ends of the cross member bottom surface 20. Using two support members 14, the overall structural soundness of the portable containment unit 10 is enhanced. In using two support members 14, the portable containment unit 10 is not easily toppled or "knocked over."

In this second embodiment, the positioning element 28 is a sharpened tip portion 44. This sharpened tip portion 44 is located on the support member second end 24 of each support member 14. Further, each sharpened tip portion 44 is constructed from a material that is able to safely and efficiently pierce or penetrate the ground surface 16. The sharpened tip portion 44 may be integral with the positioning element 28 (i.e., a sharpened tip at the end of a wooden support member 14) or a structure added to the end of the support member 14, for example a pointed metal tip added to the end of a wooden support member 14.

In order to engage the portable containment unit 10 with the ground surface 16, the user simply places his or her hands on the cross member 12 over the support members 14 and pushes downward. This movement will allow the sharpened tip portions 44 on each of the support members 14 to pierce the ground surface 16 and, thereby, securely fasten the portable containment unit 10 to the ground surface 16.

As best seen in FIG. 3, in this embodiment, the portable containment unit 10 includes three receptacles 18, each receptacle having a receptacle upper ridge portion 46 and a receptacle lower ridge portion 48. The receptacle 18 is sized and shaped such that the user may removably engage each receptacle 18 with a respective receptacle orifice 50, which extends through the cross member 12. Simply, a user need only slide each receptacle 18 through the receptacle orifice 50 until the receptacle upper ridge portion 46 rests on a cross member upper surface 52. It is this receptacle upper ridge portion 46 that is sized such that the remainder to the receptacle 18 is easily able to pass through the receptacle orifice 50, while the receptacle upper ridge portion 46 must rest upon the cross member upper surface 52. This allows for easy removal of each receptacle 18 for cleaning, maintenance and other purposes.

As shown in FIGS. 2 and 3, in this embodiment, the attachment mechanism 26 is a screw 54. Screws 54 are particularly adapted to a portable containment unit 10 manufactured from a wood material. When the portable containment unit 10 is manufactured from a plastic or metal material, it may be preferable to use an adhesive or a soldering technique. In order to secure a support member 14 to the cross member 12, a user would place the support member first end 22 in the appropriate position against the cross member bottom surface 20, and the screw 54 would be engaged with the support member first end 22.

When using screws 54, it may be preferable to provide a cross member 12 with cross member pilot orifices 56 and, similarly, provide each support member 14 with a support member pilot channel 58. In order to assemble the portable containment unit 10, the user would align the support member pilot channel 58 with the appropriate cross member pilot orifice 56, and the screw 54 would be driven through the cross member pilot orifice 56 and into and in engagement with the support member pilot channel 58.

Using a screw 54 as the attachment mechanism 26, as opposed to an adhesive or welding, the portable containment unit 10 is easily disassembled by simply removing the screws 54 and detaching the support members 14. This allows for enhanced portability of the portable containment unit 10 and, further, allows for a more flexible device.

The receptacle lower ridge portion 48 forms a receptacle recessed portion 60 around the periphery of the receptacle 18. This forms a receptacle 18 structure that is commonly known as an aid in connection with cup holders 36. The receptacle recessed portion 60 is sized such that a can or bottle is more securely placed within a respective receptacle 18. As with most cup holders 36 in the prior art, a receptacle drain orifice (not shown) may be drilled through a bottom of the receptacle 18 in order to allow the drainage of spilled beverage, condensate and other fluid.

While the above-described portable containment unit 10 has been discussed in connection with receptacles 18 for food and beverage, it is also envisioned that other attachments could be utilized or packaged with the portable containment unit 10. For example, a heating unit for attachment to a generator or outlet, a cooling tray for keeping beverages cold, a large tray element 38 for placing, for example, a game board, upon the tray element 38, etc.

In this manner, the present invention provides a portable containment unit 10, which is easily disassembled, moved and reassembled in various locations. The portable containment unit 10 is light and easily moved and adapted to a variety of ground surfaces 16. Such a portable containment unit 10 could be used at sporting events, concert venues and other similar outdoor events. Further, the portable containment unit 10 is easy in its manufacture and installation.

This invention has been described with reference to the preferred embodiments. Obvious modifications and alterations will occur to others upon reading and understanding the preceding detailed description. It is intended that the invention be construed as including all such modifications and alterations. The present invention is defined in the appended claims and equivalents thereto.

The invention claimed is:

1. A portable table comprising:

a cross member comprising recessed portions defined on opposite sides of the cross member forming at least one tapered end on the cross member adapted to support sports-related or other equipment;

at least one support member attached to and extending away from the cross member and configured to support the cross member above a ground surface; and wherein the cross member further defines at least one receptacle orifice configured to receive at least one object therein, and wherein one or more horseshoes each having two legs with ridges at the ends thereof are slid over and engage the tapered end, such that the ridges rest upon an upper of the cross member.

2. The portable table of claim 1, wherein the cross member is elongated and comprises tapered ends located at opposite longitudinal ends of the cross member.

3. The portable table of claim 1, wherein the at least one support member further comprises a positioning element configured to removably position the cross member in a substantially parallel position with respect to the ground surface.

4. The portable table of claim 3, wherein the positioning element comprises a sharpened tip portion positioned on a distal end of the support member and configured to allow at least a portion of the support member to penetrate the ground surface, thereby securely positioning the cross member with respect to the ground surface.

5. The portable table of claim 3, wherein the positioning element comprises a plate member positioned on a distal end of the support member and configured to balance the cross member above the plate member via the support member, thereby securely positioning the cross member with respect to the ground surface.

6. The portable table of claim 1, further comprising two support members attached to and extending away from the cross member.

7. The portable table of claim 6, wherein each support member includes a positioning element configured to removably position the cross member in a substantially parallel position with respect to the ground surface.

8. The portable table of claim 7, wherein the positioning elements each comprise a sharpened tip portion positioned on a distal end of each support member and configured to allow at least a portion of each support member to penetrate the ground surface, thereby securely positioning the cross member with respect to the ground surface.

9. The portable table of claim 1, wherein the at least one object comprises a receptacle configured to slide within the receptacle orifice, such that the receptacle is engaged within the receptacle orifice.

10. The portable table of claim 9, wherein the receptacle includes a ridge portion, the ridge portion configured to rest upon an upper edge area of the receptacle orifice, thereby removably securing the receptacle within the receptacle orifice.

11. A portable table, comprising:

an elongated cross member comprising recessed portions defined on opposite sides of the cross member forming two tapered ends located at opposite longitudinal ends of the cross member adapted to support one or more horseshoes;

at least one support member attached to and extending away from the cross member, the support member including a positioning element configured to removably position the cross member in a substantially parallel position with respect to the ground surface; and wherein the cross member further defines at least one receptacle orifice configured to receive at least one object therein, and whereon one or more horseshoes each having two legs with ridges at the ends thereof are slid over and engage the tapered ends, such that the ridges rest upon an upper surface of the cross member.

12. The portable table of claim 11, wherein the positioning element comprises a sharpened tip portion positioned on a distal end of the support member and configured to allow at least a portion of the support member to penetrate the ground surface, thereby securely positioning the cross member with respect to the ground surface.

13. The portable table of claim 11, wherein the at least one object comprises a receptacle configured to slide within the receptacle orifice, such that the receptacle is engaged within the receptacle orifice.

14. The portable table of claim 13, wherein the receptacle includes a ridge portion, the ridge portion configured to rest upon an upper edge area of the receptacle orifice, thereby removably securing the receptacle within the receptacle orifice.

15. The portable table of claim 11, wherein the cross member and support member are made of wood or plastic.

16. The portable table of claim 1, wherein the cross member and the support member are made of wood or plastic.

17. A portable table, comprising:

a cross member comprising opposite ends adapted to support sports-related or other equipment, the cross member defining at least one receptacle orifice;

at least one support member attached to and extending away from the cross member and configured to support the cross member above a ground surface;

at least one receptacle removably associated with the receptacle orifice, the receptacle configured to receive at least one object therein;

wherein the opposite ends of the cross member are tapered, the tapered ends formed by recessed portions defined on opposite sides of the cross member, and wherein one or more horseshoes each having two legs with ridges at the ends thereof are slid over and engage the tapered ends, such that the ridges rest upon an upper surface of the cross member.

* * * * *